United States Patent [19]

Brucken

[11] 4,400,601

[45] Aug. 23, 1983

[54] COMBINATION SWITCH AND VALVE DEVICE

[75] Inventor: Byron L. Brucken, Miamisburg, Ohio

[73] Assignee: General Motors Corporation, Detroit, Mich.

[21] Appl. No.: 298,279

[22] Filed: Sep. 1, 1981

[51] Int. Cl.[3] ..... H01H 35/34

[52] U.S. Cl. ..... 200/81.4; 200/83 Q; 200/83 W

[58] Field of Search ..... 200/81 R, 81.4, 81.5, 200/83 R, 83 J, 83 P, 83 Q, 83 S, 83 W

[56] References Cited

U.S. PATENT DOCUMENTS

| | | | |
|---|---|---|---|
| 3,005,888 | 10/1961 | Putz | 200/83 Q |
| 3,585,328 | 6/1971 | Fiore | 200/834 |
| 3,633,380 | 1/1972 | Pellizzetti | 62/217 |
| 3,702,065 | 11/1972 | Jacobs | 62/158 |
| 3,765,191 | 10/1973 | Canter | 62/228 |
| 4,133,186 | 1/1979 | Brucken | 62/228 |
| 4,191,870 | 3/1980 | Yanagisawa | 200/83 Q |

*Primary Examiner*—G. P. Tolin
*Attorney, Agent, or Firm*—R. L. Phillips

[57] ABSTRACT

A combination high pressure switch-low pressure switch and high pressure relief valve control device is disclosed having series connected high and low pressure switches which are held closed to complete a control circuit in a normal pressure operating range and are respectively responsive to pressures above and below this range to open the control circuit. A high pressure relief valve is also integrated into the control device and operates to provide high pressure relief to atmosphere at pressures substantially above the high pressure switch actuating pressure.

4 Claims, 2 Drawing Figures

COMBINATION SWITCH AND VALVE DEVICE

This invention relates to a combination switch and valve device and more particularly to a combination high pressure switch-low pressure switch and high pressure relief valve control device.

In pressure control installations such as automotive air conditioning systems employing a compressor that is driven from the engine through an electromagnetic clutch, it is common practice to provide some form of clutch switching and pressure relief to protect the compressor from certain extremes. For example, it is desirable that the compressor not operate above a certain high pressure, e.g. 550 psig, or below a certain low pressure, e.g. atmospheric (0 psig), since pressures above or below these respective extremes may adversely affect compressor life. Moreover, it is desirable that the high pressure relief which is normally to atmosphere provide secondary rather than primary protection against high pressure. Various clutch switching and pressure relief arrangements have been proposed to satisfy such requirements. However, they are typically lacking in some respects and/or are complex and require separate assemblies in order to meet all the various requirements.

The combination high pressure switch-low pressure switch and high pressure relief valve control device of the present invention is a relatively simple, easy to install, totally integrated unit capable of meeting all the various control requirements described above. This is accomplished with an electrically conductive housing for the device which is adapted to be electrically grounded on mounting in the pressure control installation, e.g. a compressor cylinder head. Both low pressure switch means and high pressure switch means are mounted in the housing and are operatively electrically connected in series therewith for adaptation in a control circuit, e.g. a compressor clutch control circuit. Pressure sensing means are also mounted in the housing and adapted to be exposed to the pressure to be sensed. In the case of the air conditioning compressor, this would, of course, be the discharge pressure from the compressor. The low pressure switch means is normally biased closed and is responsive to pressures on the pressure sensing means below a predetermined low pressure value to open. The high pressure switch means is also normally biased closed but is responsive to pressures on the pressure sensing means above a predetermined least extreme high pressure value to open whereby the high and low pressure switch means cooperatively provide an electrically conductive path to the housing and thus ground to complete the control circuit only between the low and high pressure values. In the case of the automotive air conditioning compressor electromagnetic clutch circuit, this would thus provide for engagement of the clutch and thereby operation of the compressor only between these low and high pressure values. In addition, there is provided high pressure relief valve means operable to relieve the pressure being sensed. The high pressure relief valve means is normally biased closed and is responsive to a predetermined most extreme high pressure value substantially higher than the least extreme high pressure value to only then open to provide extreme high pressure pressure relief. In the case of the automotive air conditioning system compressor, the high pressure relief valve means thus serves as secondary rather than primary high pressure protection since the high pressure switch means would normally open to disengage the clutch and shut down the compressor before high pressure relief is ever normally required by the high pressure relief valve means.

These and other objects, features and advantages of the present invention will become more apparent from the following description and drawing in which.

Figure 1:
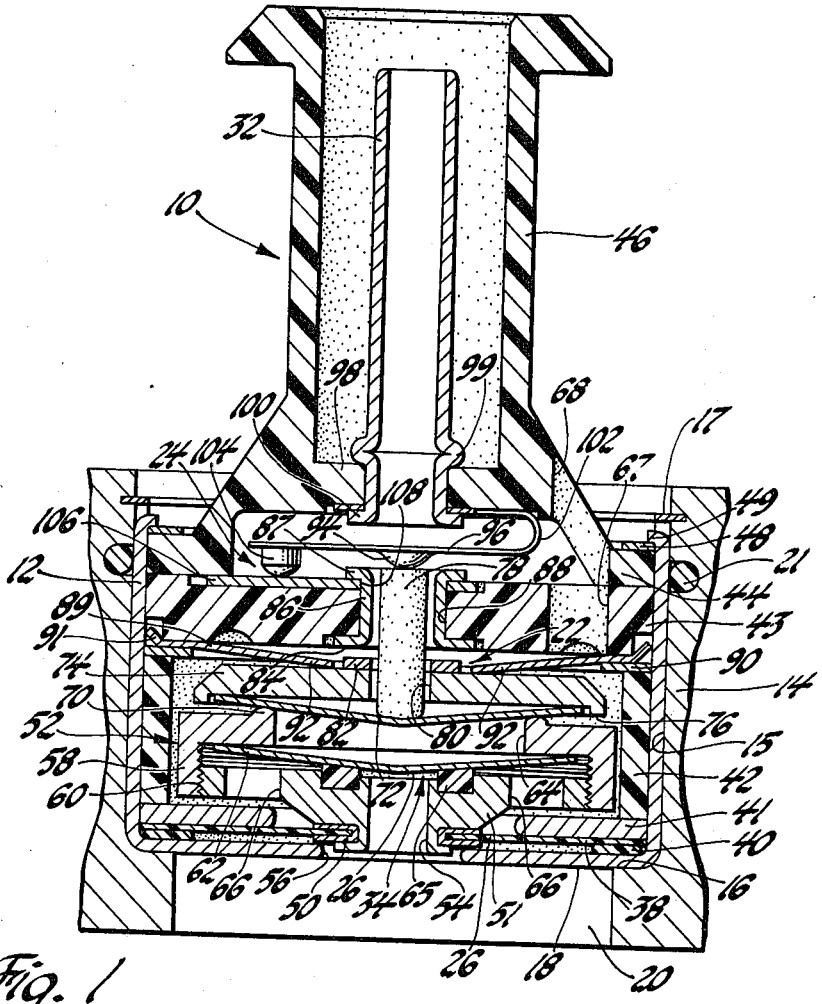
FIG. 1 is a vertical sectional view of the preferred embodiment of the combination high pressure switch-low pressure switch and high pressure relief valve control device according to the present invention; the high pressure switch and high pressure relief valve both being shown in their normal closed conditions and the low pressure switch being shown in its opened condition.

Referring to the drawing, there is shown the preferred embodiment of the combination high pressure switch-low pressure switch and high pressure relief valve control device of the present invention adapted for installation in an automotive air conditioning system such as disclosed in U.S. Pat. No. 4,133,186 entitled "Combined Electrical Cut-Off and Relief Valve", issued Jan. 9, 1979 and assigned to the assignee of the present invention and which is hereby incorporated by reference.

Figure 2:
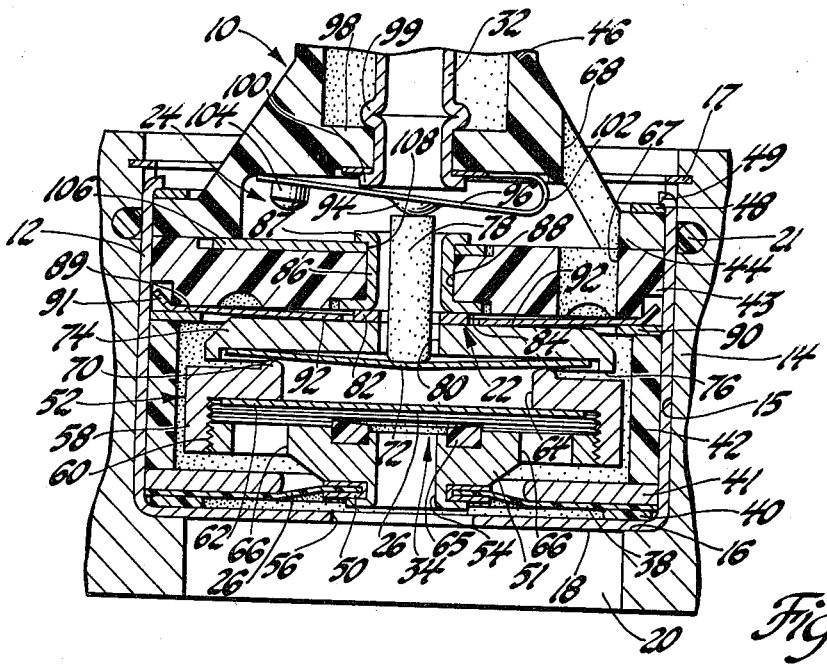
FIG. 2 is a partial view similar to FIG. 1 but showing both the high pressure switch and high pressure relief valve in their opened conditions and the low pressure switch in its normal closed condition.

The control device of the present invention which is generally designated as 10 comprises an electrically conductive housing 12 of cup-shape which is adapted to be electrically grounded on mounting in the pressure control installation, in this case the compressor's rear cylinder head 14 of which only a portion thereof is shown. The housing 12 closely fits in a counterbore 15 in the rear cylinder head 14 and is retained therein against a shoulder 16 by a retaining ring 17. The housing 12 is exposed at its inner end 18 to a cavity 20 in the compressor which is exposed to the discharge pressure and an O-ring seal 21 received in a groove in the counterbore 15 engages the outer diameter of the housing 12 to seal off the discharge pressure. Both low pressure switch means 22 and high pressure switch means 24 are mounted in the housing 12 and operatively electrically connected in series therewith for adaptation in a control circuit, in this case the control circuit for the electromagnetic clutch (not shown) through which the compressor is driven from the vehicle's engine as disclosed in the aforementioned U.S. Pat. No. 4,133,186. Pressure sensing means 26 is also mounted in the housing 12 and is adapted to be exposed to the pressure in the discharge pressure cavity 20. The low pressure switch means 22 is normally biased closed as shown in FIG. 2 and is responsive to pressure on the pressure sensing means 26 to open as shown in FIG. 1 at pressures below a predetermined low pressure value, e.g. atmospheric (0 psig). The high pressure switch means 24 is also normally biased closed as shown in FIG. 1 but is responsive to pressure on the pressure sensing means 26 to open as shown in FIG. 2 at pressures above a predetermined and least extreme high pressure value, e.g. 450 psig. The low and high pressure switch means 22 and 24 thus normally cooperatively provide an electrically conductive path to the normally grounded compressor from a terminal 32 by which the control device 10 is adapted to be connected in the clutch control circuit. Moreover, high pressure relief valve means 34 is also mounted in the housing 12 on the pressure sensing means 26 and is movable from a closed position (see FIG. 1) to an open position (see FIG. 2) to relieve the pressure being sensed, in this case the compressor discharge pressure in the cavity 20. The pressure sensing means 26 is normally biased closed below a predetermined and most extreme high pressure value, e.g. 550 psig which is substantially higher than the high pressure switch actuating pressure of 450 psig. At pressures above this most extreme high pressure value the high pressure relief valve means 34 responds thereto to open the high pressure relief valve means to provide rapid pressure relief to atmosphere.

Describing now the various details of the above integrated switch and valve arrangement, a non-conductive pressure sensing diaphragm 38 of circular shape is sealingly clamped about its perimeter against the housing end 18 through a gasket ring 40 by a washer 41. The washer 41 receives its clamping force from a non-conductive spacer ring 42 and annular switch support member 43 and a circular flange 44 of a non-conductive connector fitting 46 for the electrical terminal 32; these parts all fitting within the housing 12 and the connector flange 44 on its outer side being engaged by a retaining ring 48 against which angularly spaced tangs 49 on the housing 12 are bent to apply a clamping force to the above sandwich arrangement.

The pressure sensing diaphragm 38 has a central opening therethrough and is sealingly clamped thereabout in a collar 50 to a center member 51 of a reciprocal valve and switch force transmitting assembly 52. The center member 51 has a central passage 54 therethrough which is aligned with a larger central opening 56 through the end 18 of the housing 12, the latter opening providing for communication of the sensed pressure both with the opening 54 in the reciprocal center member 51 and with the pressure side of the diaphragm 38 (the lower side as viewed in the drawing). In the assembly 52, the center member 51 is connected to an outer collar 58 by a threaded connection 60 therebetween which provides for axial adjustment between these two connected members to calibrate the high pressure relief valve 34. The collar 58 extends radially inwardly and on its bottom side as viewed in the drawing serves as an outer peripheral seat for a disc spring 62 which extends across a central opening 64 in the collar. The disc spring 62 by its inherent bias is forced to normally engage as shown in FIG. 1 against a valve seal ring 65 that is mounted in an annular groove in the member 51 and extends about the opening 54 therethrough, the disc spring 62 thus serving as the movable valve element in the high pressure relief valve 34 which is exposed to the sensed pressure through the valve passage 54 and is urgable thereby off the valve seat 65 to open this passage. Radially outward of the valve seat 65 and facing the pressure side of the disc spring 62 there is provided a plurality of angularly spaced vent holes 66 which are open to atmosphere internally of the spacer 42 and through aligned vent holes 67 and 68 in the switch support member 43 and connector 46, respectively. Thus, there is provided a vented connection between the pressure side of the disc spring 62 and atmosphere through the interior of the control device 10 when the high pressure relief valve 34 opens.

The force transmitting collar 58 has on its upper side as viewed in the drawing and about its central opening 64 an upstanding annular rib 70 which serves as a fulcrum for a second disc spring 72 which is a part of the high pressure switch 24. The disc spring 72 engages at its perimeter with a disc shaped actuator member 74 of conductive material and is centered relative thereto by an annular peripheral shoulder 76 formed on the member 74. The disc spring 72 engages at its center and inward of the fulcrum 70 with a high pressure switch actuator pin 78 of non-conductive material which extends through a central opening 80 in the actuator member 74. An annular low pressure switch contact 82 is secured to the upper side of the actuator member 74 about the central opening 80 therethrough and is engageable with a radially outwardly extending annular flange 84 of a stationary low pressure switch contact member 86 which is secured by the flange 84 and a similar flange 87 on the opposite side in a central opening 88 in the non-conducture switch support member 43. An annular spring 89 is secured about its periphery in the device by being clamped between the non-conductive support member 43 and a conductive washer 90 which engages the spacer 42 and also has edge contact with the inner diameter of housing 12. The annular spring 89 has a bent edge 91 which is pressed against the housing 12 for conductive contact therewith in addition to that through washer 90. The annular spring 89 also has a plurality of angularly spaced, radially inwardly projecting spring fingers 92 which contact at their ends with the conductive actuator member 74 to urge the lattice downward and open the low pressure switch contacts 82 and 86.

The non-conductive high pressure switch actuator pin 78 extends through the stationary low pressure switch contact 86 and engages a rounded cam 94 formed on a high pressure switch leaf spring 96 which is secured by clamping to the underside of a radially inwardly extending annular shoulder 98 of the non-conductive connector member 46. This securing is accomplished by an upset flange 99 on the hollow connector 32 on the upper side of shoulder 98 and flanging over the lower end 100 thereof so as to provide a secure electrical contact between the device's connector terminal 32 and the high pressure switch contact spring 96. The contact spring 96 is formed with a 180° bend 102 between its point of attachment and its cam 94 and at its other end there is secured thereto a contact 104 which is urged by the inherent spring bias of the leaf spring to engage a contact strip 106. The high pressure switch contact strip 106 is clamped to the upper side of the non-conductive switch support member 43 between the latter and the underside of the non-conductive connector flange 44 and by the flange 87 on the stationary low pressure switch contact 86, the flange 87 being bent over the edge of a hole 108 in the strip through which the contact 86 extends to thereby secure as well as make a good electrical connection between the stationary high and low pressure switch contacts 106 and 86.

Having described the control device's structural details, there specific functions will now be related. Under normal air conditioning system operating conditions, the diaphragm 38 operating through the force transmitting assembly 52, the spring 72 and actuator member 74 overcomes the force of spring 89 and holds the low pressure switch contacts 82 and 86 closed with a predetermined force as calibrated by the threaded connection 60. At the same time there is sufficient space between the spring 72 and the cam 94 on the spring 96 so that the latter holds the high pressure switch contacts 104 and 106 closed. With both the low pressure switch 22 and high pressure switch 24 closed, which is the normal condition, the circuit to the compressor's electromagnetic clutch is thus completed; this path being from the connector terminal 32 through the closed and series connected switches 24, 22 and thence via the low pressure switch spring 89 to the grounded housing 12. However, if the system loses its refrigerant charge, i.e. leak to atmospheric pressure, or if the system is in ambient temperatures causing system pressure to be reduced to atmospheric pressure or below, this reduction in pressure on the diaphragm 38 will allow the spring 89 to force the actuator member 74, spring 72 and assembly 52 all downward to disengage the contact 82 from the contact 86 thus opening the low pressure switch 22 and thereby the clutch control circuit to disengage the compressor clutch. Thus the compressor is protected from operating under the above abnormal low pressure conditions which would affect its life. On the other hand, if discharge pressure because of system component malfunction or excessive temperature rises above the high pressure switch setting, e.g. 450 psig, this pressure acting on the diaphragm 38 and the exposed pressure side of spring 62 through the valve passage 54 is effective to move the assembly 52 upward and with the actuator member 74 bottomed out in its low pressure switch closed condition, the spring 72 is deflected forcing the actuator pin 78 upward to deflect the leaf spring 96 and thus open the high pressure switch 24 and thereby the clutch control circuit to disengage the compressor clutch. Then as to the high pressure relief valve 34, should the compressor discharge pressure for some reason start to exceed the most extreme high pressure to be allowed, e.g. 550 psig, and which is beyond that required to open the high pressure switch 24, this pressure acting directly on the disc spring 62 urges it off the valve seat 65 into the open position shown in FIG. 2. With the high pressure relief valve open, the excessive discharge pressure is then rapidly relieved through the valve opening 54 and the vent holes 66, 67 and 68 to atmosphere, the communication between the vent holes 66 and 67 being provided by the annular space between the assembly 52 and the spacer 42 and the spaces between the fingers 92 of the spring 89.

The above-described preferred embodiment is illustrative of the invention which may be modified within the scope of the appended claims.

The embodiments of the invention in which an exclusive property or privilege is claimed are defined as follows:

1. A combination high pressure switch-low pressure switch and high pressure relief valve control device comprising: an electrically conductive housing adapted to be electrically grounded on mounting in a pressure control installation, low pressure switch means and high pressure switch means mounted in said housing and operatively electrically connected in series thereof for adaptation in a control circuit, said low pressure switch means including biasing means for urging opening thereof, force transmitting means mounted in said housing having pressure sensing means adapted to be exposed to a pressure to be sensed for normally holding said low pressure switch means closed and responding to pressures below a predetermined low pressure value to effect opening of said low pressure switch means by its biasing means, said high pressure switch means including biasing means for urging closure thereof, said force transmitting means being further responsive to pressure on said pressure sensing means above a predetermined least extreme high pressure value to open said high pressure switch means against its biasing means whereby said high and low pressure switch means cooperatively provide an electrically conductive path to said housing only between said predetermined low pressure value and least extreme high pressure value, and high pressure relief valve means mounted in said housing having biasing means for urging closure thereof, said high pressure relief valve means further having pressure sensing means adapted to be exposed to the pressure to be sensed for responding to pressures above a predetermined most high pressure value substantially higher than least extreme pressure value to open said high pressure relief valve means to provide extreme high pressure relief.

2. A combination high pressure switch-low pressure switch and high pressure relief valve control device comprising: an electrically conductive housing adapted to be electrically grounded on mounting in a pressure control installation, low pressure switch means and high pressure switch means mounted in said housing and operatively electrically connected in series thereof for adaptation in a control circuit, said low pressure switch means including biasing means for urging opening thereof, force transmitting means mounted in said housing having pressure sensing means adapted to be exposed to a pressure to be sensed for normally holding said low pressure switch means closed and responding to pressures below a predetermined low pressure value to effect opening of said low pressure switch means by its biasing means, said high pressure switch means including biasing means for urging closure thereof, said force transmitting means being further responsive to pressure on said pressure sensing means above a predetermined least extreme high pressure value to open said high pressure switch means against its biasing means whereby said high and low pressure switch means cooperatively provide an electrically conductive path to said housing only between said predetermined low pressure value and least extreme high pressure value, and high pressure relief valve means mounted on said force transmitting means, said high pressure relief valve means including biasing means for urging closure thereof, said high pressure relief valve means further including pressure sensing means adapted to be exposed to the pressure to be sensed for responding to pressures above a predetermined most extreme high pressure value substantially higher than least extreme pressure value to open said high pressure relief valve means against its biasing means to provide extreme high pressure relief.

3. A combination high pressure switch-low pressure switch and high pressure relief valve control device comprising: an electrically conductive housing adapted to be electrically grounded on mounting in a pressure control installation, low pressure switch means and high pressure switch means mounted in said housing and operatively electrically connected in series thereof for adaptation in a control circuit, said low pressure switch means including biasing means for urging opening thereof, force transmitting means mounted in said housing having pressure sensing means adapted to be exposed through an open end of said housing to a pressure to be sensed for normally holding said low pressure switch means closed and responding to pressures below a predetermined low pressure value to effect opening of said low pressure switch means by its biasing means, said high pressure switch means including biasing means for urging closure thereof, said high pressure switch means further including actuator means extending through said low pressure switch means, said force transmitting means being further responsive to pressure on said pressure sensing means above a predetermined least extreme high pressure value to act on said actuator means to effect opening of said high pressure switch means against its biasing means whereby said high and low pressure switch means cooperatively provide an electrically conductive path to said housing only between said predetermined low pressure value and least extreme high pressure value, and high pressure relief valve means mounted in said housing on said force transmitting means, said high pressure relief valve means including biasing means for urging closure thereof, said high pressure relief valve means further including pressure sensing means integral with its biasing means adapted to be exposed to the pressure to be sensed through said open end of said housing for responding to pressures above a predetermined most high pressure value substantially higher than least extreme pressure value to open said high pressure relief valve means against its biasing means to provide extreme high pressure relief.

4. A pressure actuated switch assembly comprising housing means defining a cavity having an opening to admit a fluid under pressure, support means spanning said cavity and having an opening therethrough, separate movable switch means registered with said opening on each side thereof, an actuator pin telescoped in said opening and engaging at one end with one of said movable switch means, a floating spring disc engaging centrally thereof with the opposite end of said actuator pin, a floating substantially rigid disc having an opening therethrough telescoped on said actuator pin and engaging on opposite sides thereof with the other of said movable switch means and said spring disc at the outer periphery thereof, force transmitting means engaging said spring disc inboard the outer periphery thereof on the side opposite said rigid disc and subject to movement toward said rigid disc determined by the fluid pressure, and said apparatus so constructed and arranged that under fluid pressure exerted on said force transmitting means said other movable switch means is first closed without substantial flexing of said spring disc with movement of said rigid disc to a stop position and then at a higher pressure said spring disc flexes by reaction of the stopped rigid disc to bodily move said actuator pin and open said one movable switch means.

* * * * *